US011482124B2

(12) United States Patent
Sassinsky

(10) Patent No.: US 11,482,124 B2
(45) Date of Patent: Oct. 25, 2022

(54) AEROSPACE HAZARD DETECTION, RECOGNITION, PRIORITIZATION AND WARNING DEVICE, SYSTEM AND ASSOCIATED METHODS

(71) Applicant: Jeffrey Brian Sassinsky, Haddonfield, NJ (US)

(72) Inventor: Jeffrey Brian Sassinsky, Haddonfield, NJ (US)

( * ) Notice: Subject to any disclaimer, the term of this patent is extended or adjusted under 35 U.S.C. 154(b) by 0 days.

(21) Appl. No.: 17/028,075

(22) Filed: Sep. 22, 2020

(65) Prior Publication Data

US 2021/0097873 A1 Apr. 1, 2021

Related U.S. Application Data

(60) Provisional application No. 62/906,774, filed on Sep. 27, 2019.

(51) Int. Cl.
*G08G 5/04* (2006.01)

(52) U.S. Cl.
CPC ..... *G08G 5/04* (2013.01)

(58) Field of Classification Search
None
See application file for complete search history.

(56) References Cited

U.S. PATENT DOCUMENTS 10,302,759 B1 * 5/2019 Arteaga ..... G08G 5/0082
2016/0335898 A1 * 11/2016 Caplan ..... H04M 1/72415
2017/0301250 A1 * 10/2017 Ell ..... G01S 17/933
2018/0101782 A1 * 4/2018 Gohl ..... G06N 7/005
2018/0253983 A1 * 9/2018 Ell ..... G06T 7/55
2019/0103031 A1 * 4/2019 Evans ..... G08G 5/0091

FOREIGN PATENT DOCUMENTS

EP 3372508 A1 * 9/2018 ..... G06T 7/521

* cited by examiner

*Primary Examiner* — Fekadeselassie Girma

(57) ABSTRACT

The present invention is a device, method(s) and system for detecting, processing, ranking, prioritizing and presenting potential flight hazards to the pilot and/or operator of an aircraft to improve the safety of flight and assist the pilot in recognizing potential hazards and hazardous conditions while not overwhelming the pilot with unimportant information or low risk hazards not currently germane to the safe and effective operation of the aircraft. In particular, the invention presents a novel and useful device, method(s), and system for determining the potential risks posed by an object(s) and condition(s) in the flight environment and ultimately prioritizing the information presented to the pilot. In certain embodiments, the invention calculates the potential for hazards and hazardous conditions that have not been directly detected but may be inferred to exist based on previous or current calculations or detected conditions and/or objects. In certain embodiments, the invention stores and/or shares the information it has gathered and/or processed for future use by the invention, use by other users of the invention, or use by other parties and for other purposes altogether.

18 Claims, 6 Drawing Sheets

AEROSPACE HAZARD DETECTION, RECOGNITION, PRIORITIZATION AND WARNING DEVICE, SYSTEM AND ASSOCIATED METHODS

CROSS REFERENCE

This patent application claims the benefit of provisional patent application 62/906,774, titled Aerospace Hazard Detection, Recognition, Prioritization and Warning Device, System and Associated Methods, which is hereby incorporated by reference in its entirety.

FIELD OF THE INVENTION

The present invention relates generally to aviation and, more specifically, to the field of aerial sensing, and recognizing hazards, and determining potential risk, and prioritizing hazards, and inferring potential hazards and/or objects, and storing and/or sharing such information.

BACKGROUND OF THE INVENTION

It would be advantageous to have a device and/or system and/or method for warning the operator or pilot or system controlling an aircraft, whether said aircraft is manned or un-manned, of potential hazards in the aircraft's flight environment. Note that the terms operator, pilot and flight control system are used interchangeably in this document. More specifically, it would be desirable to sense potential hazards using real time or near real time sensors and process said data using a computing device to determine the type and/or characteristics of the object(s) that presents a potential hazard. Additionally, it would be desirable to programmatically evaluate and rank the hazards by risk based on several factors, which may include, but not intended to be a limitation, type, characteristics, material, movement, distance, vulnerability, aircraft movement, aircraft maneuverability, environmental conditions, etc. Additionally, in certain instances, it would be desirable to prioritize and/or present to the pilot/flight control system the most critical hazard(s) based on risk assessment. Additionally, in certain instances, it would be desirable to store the sensed and/or processed information and/or to share the sensed and/or processed information with other systems, whether on the aircraft or not, and/or other potential users of the information.

SUMMARY OF THE INVENTION

The present invention advantageously fills the aforementioned deficiencies by sensing, analyzing, ranking, prioritizing and presenting hazards around an aircraft so that the pilot (or "operator", or "flight control system", which are used interchangeably in this document and to be taken as alternatives even when only one is included in the text) can avoid or minimize the risk of a collision or dangerous flight condition. The invention senses, recognizes, evaluates, ranks and prioritizes the hazards according to advanced algorithms and data analysis techniques such as, but not intended to be a limitation, object recognition, object tracking, sensor fusion, data fusion, comparison to previous flight conditions, and/or comparison to stored data. The invention takes into account data obtained from one or more sources such as, but not intending to be a limitation, radar(s), an infrared sensor(s), an electro-optical sensor(s), a laser ranging sensor(s), an ultrasonic sensor(s), LiDAR(s), GPS, inertial navigation, electronically stored data, as well as flight, aircraft and/or engine condition sensors.

When operating an aircraft, it is optimal to avoid all hazards. However, this is often impossible. Certain flight environments or missions require the pilot to accept a certain amount of risk. An example of such a mission, but not intending to be a limitation, is a medivac helicopter flight. Medivac missions often require the helicopter to land off-airport in a landing zone ("LZ") which may have potential collision hazards. In this case, it is advantageous for the pilot and/or flight control system to have assistance in determining, at any given moment, the most pressing collision or environmental hazard(s) affecting the aircraft. This permits the pilot and/or flight control system to recognize and dedicate proper resources and attention to the object or condition that is most likely to cause an accident.

Examples of collision hazards include, but are not limited to, terrain, vegetation, structures, people, animals, other aircraft, vehicles, etc. However, hazards may also be a specific condition that poses a flight risk.

An example, but not intending to be a limitation, of such a condition may occur when hovering a helicopter near a structure. In certain instances, the downwash from the rotor impacts the building and is mechanically forced back into the rotor system. This causes a hazardous condition known as vortex ring state which can cause the aircraft to lose lift and crash.

The invention helps the pilot and/or flight control system recognize and reduce risks such as the examples given by sensing, detecting, monitoring and prioritizing the potential hazards around the aircraft. This permits the pilot and/or flight control system to focus on flying the aircraft and assists in maintaining situational awareness of the flight environment and potential hazards. It also alerts the pilot and/or flight control system of hazards of which they may be unaware. This can be instrumental in preventing an incident or accident, of which many prove to be serious.

For example, the invention in certain embodiments, but not all, utilizes data gathered from electro-optical sensors ("cameras") viewing the environment around the aircraft. It then processes the images using a computing device and computer program that classifies and categorizes objects contained in the images using object recognition algorithms. The classification of the object, and in some instances, along with other information concerning the object such as distance, size, extent, location, or other physical and non-physical characteristics, is utilized by a process contained in the invention to calculate a risk value for the object. For example, but not intending to be a limitation, a detected person in the vicinity of the aircraft may receive a higher risk value than low density vegetation at the same distance from the aircraft. In this example, the process is programmed to recognize that a person may move toward the aircraft however vegetation will not. The process may also be programmed to increase the risk level for the person because of the increased risk of loss of life should the aircraft collide with the person as compared to impacting low density vegetation. Therefore, it is advantageous for the pilot to be alerted that a person may be approaching the aircraft before or instead of being alerted that low density vegetation is in the vicinity of the aircraft. The pilot can plan and/or adjust the aircraft's movement or position accordingly.

The risk levels of all detected objects and hazards are calculated on an ongoing basis and compared with each other. Objects with a risk value above a certain threshold are prioritized and presented to the pilot/flight control system in a manner that alerts them to the most important factors, as determined by the invention, at that time. The information presented to the pilot is modified on an ongoing basis as sensed objects, conditions and risk levels change.

In certain embodiments, but not all, the invention presents to the pilot a symbol, visual video, and/or graphical image of the object(s) and/or hazard(s) surrounding the aircraft. It determines the most important object(s) based on the risk analysis and presents one or more of them. In certain embodiments, it presents the risk ranking. The risk ranking may be shown using one or more cues, such as, but not intending to be a limitation, a number, text, color, icon, symbol, sound, or other. In certain embodiments, but not all, the invention highlights the hazard in the visual video image using one or more of a multitude of methods, such as but not intending to be a limitation, a box around the object, a color overlay, an icon, symbol, annunciator, or other.

In certain embodiments, but not all, the invention presents to the pilot a visual representation of the object(s) and/or hazards around the aircraft. As an example, but not intending to be a limitation, it may use a simple to understand display depicting where sensed, recognized and/or categorized objects and/or hazards have been detected and/or processed around the aircraft. One method for doing so, but not intending to be a limitation, the display may present depictions for different hazard and/or object types on a radar like or top-down display with a representation of the aircraft at the center, on an edge, or anywhere in-between. In certain embodiments, but not all, the invention presents a wedge type overlay in the direction of a hazard highlighting to the pilot the increased risk to the aircraft should it be flown in that direction. In certain embodiments, but not all, the invention presents an icon and/or text indication of the hazard type. This assists the pilot by allowing her to easily see with one glance the direction in which a potentially hazardous condition exists. As another example display method, but not intending to be a limitation, the display may present depictions for different hazard and/or object types on a synthetic vision like presentation with a computer-generated representation of the sensed and/or processed hazards around the aircraft from the pilot's point of view. As another example display method, but not intending to be a limitation, the invention may overlay computer generated icons, symbols, text, imagery, video, etc. depicting sensed and/or processed hazards on a live image and/or video of the area around the aircraft. As a final example display method, but not intending to be a limitation, the invention may overlay computer generated icons, symbols, text, imagery, video, etc., on a heads-up display ("HUD") in the pilot's field of view. Other methods and/or symbols may be used to indicate areas of potential hazards or hazardous conditions.

Conversely, in certain embodiments, but not all, the invention suppresses showing an object or hazard sensed and/or processed around the aircraft because it has calculated that there is a low risk associated with the object or there are other objects that are more pressing. This assists the pilot by hiding information that it deems currently unimportant, or less important than other information, allowing the pilot to focus on the information that presents the largest risks to the safety of flight. Data overload and fixation can be detrimental when flying an aircraft and can cause the pilot to take actions that are not necessary, focus on risks that are not presently important, ignore more pressing hazards, or experience slow decision-making. Data overload can also distract the pilot from the act of flying the aircraft thereby causing an unintended secondary hazard.

In certain embodiments, but not all, the invention stores on a data storage device and/or in a database the collected and processed information, including but not intending as a limitation, location, height, size, category, movement, and/or other pertinent and/or identifying information. The data storage device may be located within the invention, remotely, or both. The invention can utilize the stored data to present potential object and/or hazard data to the pilot, the flight control system, interested third parties, or other devices for uses such as, but not intending to be a limitation, charting, flight planning, approach, landing and takeoff safety. In these cases, the data is retrieved from the storage device and would be available prior to the invention's sensors detecting and processing objects and hazards. An example benefit of the invention's ability to store object and/or hazard data, but not intended as a limitation, is allowing the pilot to examine the conditions and potential hazards at a location previously sensed and processed by the invention prior to arriving at the location.

In certain embodiments, but not all, the invention compares collected and/or processed information with previously collected, processed and/or stored information in order to determine if changes occurred to objects and/or hazards around the aircraft or in the intended flight area. Pilots that operate an aircraft more than once in the same area, especially when they operate in that area routinely, often have a preconceived perception of what to expect in the form of objects, terrain, and hazards. This can cause a condition where the pilot operates the aircraft according to what they expect and not based on the actual conditions that exist. They may unintentionally ignore, miss, or not recognize changes in the flight environment, including new, different, or unexpected objects and/or hazards. The invention can recognize a change that has occurred and alert the pilot to the difference by comparing currently collected information with previously collected information. For example, but not intending to be a limitation, a new structure has been built or a tree has grown. In this embodiment, the invention alerts the pilot to the new hazard. Bringing this to the pilot's attention helps him avoid a hazard he may not have otherwise recognized. This is advantageous and can prevent incidents or accidents.

In certain embodiments, but not intending to be a limitation, the invention electronically stores and/or shares processed data among installed units or with third parties. This allows object and potentially hazardous condition information to be disseminated to invention users and third parties thereby improving the usefulness of the invention for all. For illustrative purposes, but not intending to be a limitation, an aircraft equipped with the invention can collect and process object and hazard data while in flight. The processed and/or stored data is electronically transferred, through any one of various means, to a remote storage and/or processing system(s). Another aircraft that is equipped with the invention can electronically receive, through any one of various means, the information, or any subset thereof, collected by the previous aircraft(s) to operate in the area. The pilot and/or flight control system of the subsequent aircraft are now better prepared for operations in the area by making use of the information collected and processed by other aircraft equipped with the invention. Furthermore, the information collected by the invention can be utilized by non-invention users for various purposes, such as, but not intending to be a limitation, charting and map making, autonomous vehicle navigation database creation, construction planning, research, flight planning, security, etc.

In some embodiments, but not intending to be a limitation, the invention calculates a risk value for detected and processed objects by making use of multiple parameters, algorithms and collected data. This may be performed in various manners, including but not intending to be a limitation, through object recognition algorithms, comparison to previously collected data, current aircraft conditions, sensed and/or collected environmental conditions, etc. As an example, but not intending to be a limitation, the invention detects an object in the vicinity of the aircraft and determines that the object is a person. It detects a second object in the vicinity of the aircraft and determines that the object is vegetation. The invention then applies a higher risk value to the person than the vegetation and prioritizes, informs, and/or warns the pilot as is appropriate. As another example, but not intending to be a limitation, the invention determines through comparison with stored data that a structure is sensed where one was not previously sensed. The invention then increases the risk value of this hazard given that the pilot may not recognize that a change has occurred to the area. Furthermore, the invention may depict that this is a new hazard through the use of one or more methods, including but not limited to, symbols, text, color, tones, etc.

In some embodiments, but not intending to be a limitation, the invention calculates a risk value for detected and processed abstract flight conditions that may not be classified as traditional physical objects. For example, but not intended to be a limitation, such flight conditions may include downdrafts, cloud formations that may contain turbulence, rain, snow, potential icing conditions, sloped landing areas, individual or flocks of birds, etc. These conditions may be recognized using various means, including but not intending to be a limitation, utilizing algorithms to compare the current flight environment, such as detected and recognized objects, flight data, environmental conditions, such as temperature, altitude, etc. and/or aircraft orientation including speed, direction of flight, vertical speed, etc. to previously known conditions, or combinations of conditions, that may be hazardous to the flight or of interest to the pilot. As an example, but not intended to be a limitation, when attached to a rotorcraft, the invention may detect a flat sided structure with an adjoining open area free of vegetation. Furthermore, for example purposes only, it may recognize that the rotorcraft is in a descent or a hover. The invention then compares this configuration of objects and conditions to known hazardous combinations for rotorcraft and recognizes that there is a higher likelihood of a condition known as vortex ring state to occur. Vortex ring state can cause a rotorcraft to lose lift and crash. The invention then warns the pilot of the increased risk of this condition through one or multiple means, such as, but not intending to be a limitation, an annunciator, graphic, icon, text, tone, tactile feedback, illuminated light, or spoken voice. The pilot can then take action to avoid this hazard thereby limiting the likelihood of an incident or accident.

In some embodiments, but not intending to be a limitation, the invention tracks objects over time and recognizes trends in relative object movement. For illustrative purposes, but not intending to be a limitation, the invention may be used by the pilot of an aircraft during taxi ("ground movement") operations. The invention uses one or more of its capabilities, such as but not intending to be a limitation, object recognition and/or object tracking, to recognize another aircraft and track its relative position. By tracking the other aircraft's position and movement relative to its own, the invention determines if the two aircraft paths are likely to intersect. The invention then warns the pilot, through one or more means, of the risk of a collision should the calculated risk exceed a predefined and/or set threshold.

In some embodiments, but not intending to be a limitation, the invention infers hazards based on sensed and recognized objects and conditions. This is especially useful for objects that are difficult to be sensed directly by present sensors, systems and methods. For illustrative purposes, but not intending to be a limitation, the invention may recognize one or more power transmission poles in the vicinity of the aircraft. The invention then determines it is likely that power transmission wires exist between the poles even though the wires have not been directly sensed. It then presents this information, including the inferred power transmission wires, to the pilot through one or more means, such as, but not intending to be a limitation, displaying a graphic depiction of the wires on a display, an icon, an annunciator, a tone, a spoken voice, or other. The inferred object and/or hazard capability can be utilized for many types of objects and hazards, especially those that are difficult to sense directly, including but not limited to, guy wires around a tower, ski lift cables, antennas, light poles, etc.

Through the embodiments described in this disclosure, as well as other embodiments that may not be disclosed herein but will come to mind of those skilled in the art to which this invention pertains, the invention presents a novel, non-obvious and useful advance to the state of the art.

REFERENCE NUMERALS IN THE DRAWINGS

Figure 1:
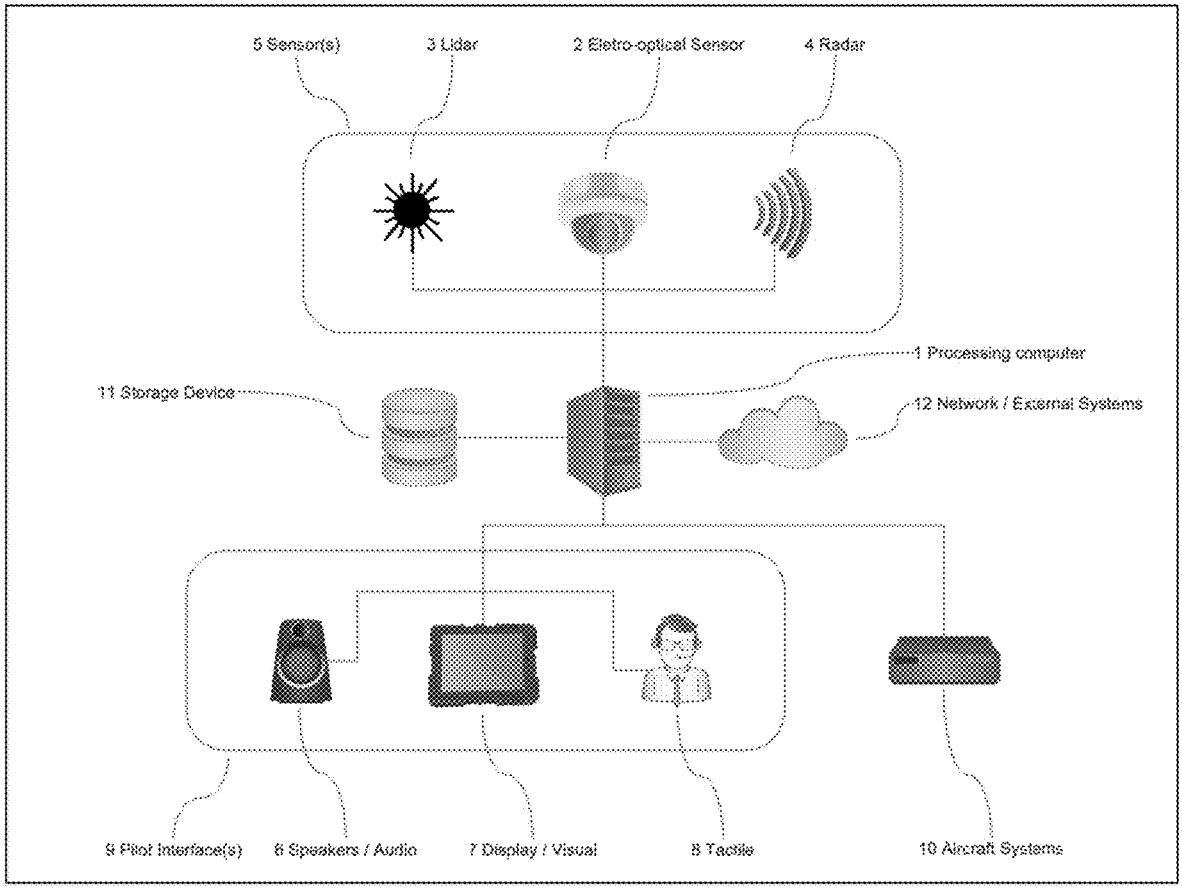
FIG. 1 is a drawing depicting one possible operating environment of the present invention.

1) Processing computer
2) Electro-optical sensor
3) Lidar
4) Radar
5) Sensor(s) group
6) Speakers/audio
7) Display/visual
8) Tactile
9) Pilot interface(s)
10) Aircraft systems
11) Storage device
12) Network/external systems
13) Aircraft
14) Generic objects
15) Person

DETAILED DESCRIPTION OF THE INVENTION

The present invention will now be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein. Instead, these embodiments are provided by way of illustration only so that this disclosure will be thorough and convey the full scope of the invention to those skilled in the art.

The invention is directed to a device, system and associated methods to be used in connection with identifying, conveying, and, if appropriate, warning of a potential collision or hazardous condition affecting an aircraft, and more specifically, categorizing, calculating risk and/or prioritizing said hazards. In some embodiments, but not all, the present invention is additionally directed to a device, system and associated methods to be used for inferring potential hazards or hazardous conditions given collected and processed data. In some embodiments, but not all, the present invention is additionally directed to a device, system and associated methods for storing and/or sharing collected and processed hazard information.

Figure 2:
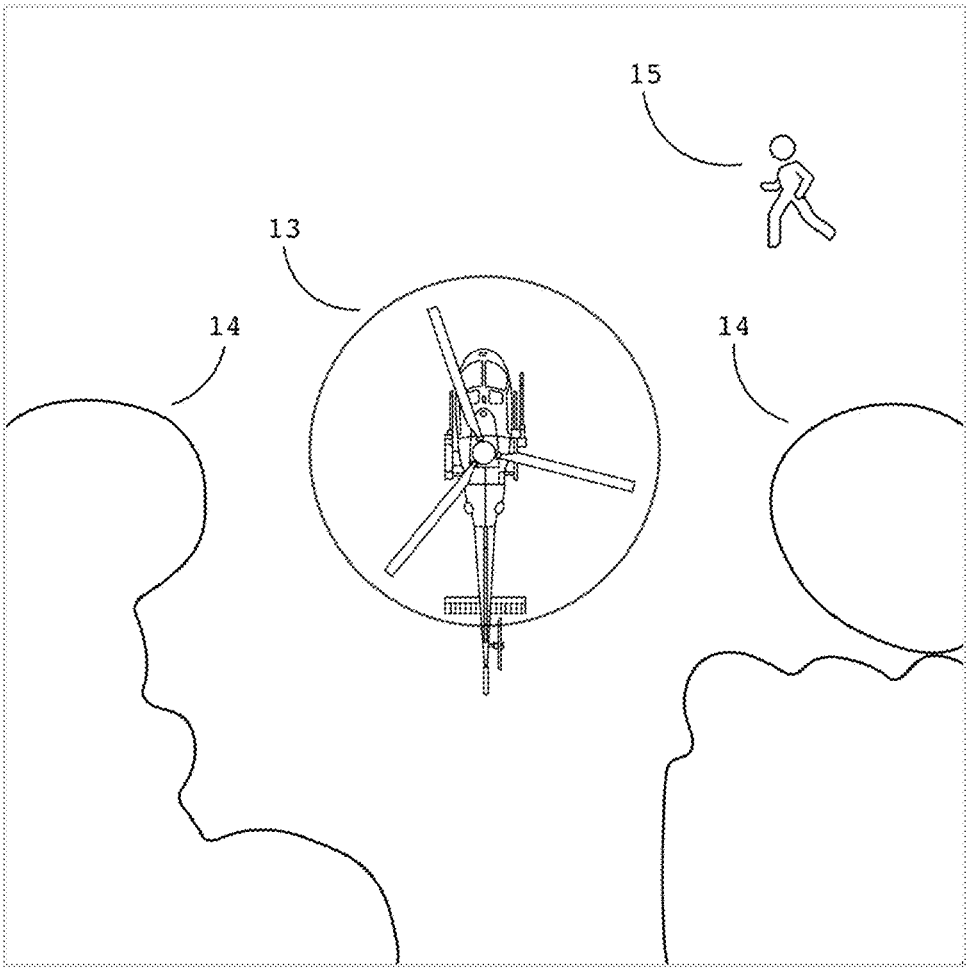
FIG. 2 is a block diagram depicting components and systems of one or more possible embodiments of the present invention.

Referring to FIG. 2, the invention, in some embodiments but not all, is designed to be used in an aviation setting on an aircraft (13). Although the figure depicts a rotorcraft, the invention may be used with rotorcraft, fixed-wing, multirotor, lighter-than-air, or another type of air vehicle, whether manned or unmanned. It will sense, detect and process information and characteristics associated with objects (14) and other animate or inanimate items, such as, but not limited to, people (15), as well as various aircraft and environmental conditions within the vicinity of the aircraft. As an example, but not intending to be a limitation, environmental conditions may include temperature, wind, windshear, airflow, clouds, humidity, the presence of precipitation, the presence and amount of daylight, or other environmental states. Various conditions may also include, but not intending to be a limitation, aircraft speed, direction, orientation, engine parameters, engine condition, aircraft parameters, aircraft condition, flight control inputs, navigation information, or other aircraft state and systems information.

Referring to FIG. 2, the invention, in some embodiments but not all, consists of sensors (5) that utilize various means to detect the objects and environment in the vicinity of the aircraft. For illustrative purposes only, and not intending to be a limitation, the sensors may detect objects such as structures, vehicles, persons, animals, terrain, vegetation, other aircraft, or other items, whether animate or inanimate, having some form and structure. For illustrative purposes, but not intending to be a limitation, the invention may do so utilizing one or more sensors such as lidar/laser rangefinder(s) (3), electro-optical (2), and/or radar (4). In some embodiments but not all, the invention may include sensors that detect environmental conditions in the vicinity of the aircraft. For illustrative purposes, but not intending to be a limitation, the invention may do so utilizing one or more sensors such as thermometers, pitot tubes, wind vanes, angle of attack sensors, moisture sensors, light sensors, or other sensors that detect environmental conditions.

Should the invention not contain a sensor capable of detecting a particular parameter, but the aircraft and/or an external system does, the invention may, in certain embodiments but not all, connect to and transfer information from an external system using a data transmission channel or device (12) to obtain the desired data. For example, but not intending to be a limitation, the invention may connect to the aircraft's onboard pitot-static system to obtain airspeed and altitude information or connect to the aircraft's AHARS system to obtain aircraft orientation information. In some instances, but not all, the invention may connect to an external server via an onboard or aircraft provided data network to obtain a particular parameters or data. An example, but not intending to be a limitation, would be obtaining data linked NEXRAD radar information from a ground-based source which is thereby transmitted to the aircraft.

In some embodiments, but not all, the invention will go beyond directly sensing objects and conditions and will instead calculate the possibility of objects and conditions existing, some of which may be hazardous, that have not been directly sensed. It will do so by referring to sensed, stored, and/or transmitted data and comparing said information with known information, patterns, programming, or other indications, whether stored on calculated in real time, that may indicate the possibility of the existence of objects and/or conditions that may exist in the vicinity of the aircraft but that are not directly sensed. This is similar to how humans may process observed information to infer items not directly sensed. To illustrate the concept, a human may observe leaves on a tree moving and infer the existence of wind without feeling, or in other words, directly sensing, the wind. Similarly, the invention may observe parameters regarding an object(s) or condition(s) using a sensor(s) and infer the likely existence of another object(s) or condition(s) without directly sensing the second object/condition. As an example, but not intending to be a limitation, the invention may sense and recognize power transmissions towers and infer the likely existence of power transmission wires between the towers. This demonstrates one example benefit of the invention in that power transmission wires, which are extremely hazardous to aircraft operating at low altitudes, can be notoriously difficult to directly sense, especially with low cost and/or widely available sensors.

In some embodiments but not all, the invention can also use additional stored, programmed, and/or transmitted data to augment, modify, or place into context, the information gathered from the sensors. As an example, but not intending to be a limitation, the invention may sense an object such as a power transmission tower and refer to a database of known power transmission towers in the area to augment the sensed object. The invention can use the additional information with the sensed information to infer from the combination that power transmission wires are likely to exist in the area. The approximate location and direction of the inferred wires are more difficult to calculate using on a single sensed power transmission tower than when taking into account the previously known power transmission towers.

The sensor(s) are connected to a processing computer(s) (1) using various means, which may include but not intending to be a limitation, digital data wiring, wireless data communication, analog wiring, a shared data bus, or other method or device capable of transferring digital or analog data. The processing computer implements the invention's processes, methods and/or algorithms to perform various operations. For illustrative purposes, but not intending to be a limitation, these operations may include receiving and processing data from sensors (5), calculating the geographic or relative location of sensed objects, calculating risk assessments, prioritizing risk assessments that have been calculated, calculating the possibility of potentially hazardous conditions, calculating ("inferring") the possibility of objects that may exist in the flight environment but were not directly sensed, determining sensed object type, reading and/or storing data on a data storage device (11), transferring data to and/or from a network(s) and/or an external system(s) (12), creating a depiction of sensed, processed and/or deduced data to be displayed on a flight display (7), creating an audio signal to be played on an audio device (6), producing a signal to be transformed into a tactile sensation and/or movement (8), and/or transferring data and/or signals to and/or from an aircraft system(s) (10) external to the invention.

Continuing with FIG. 1, the invention, in some embodiments, but not all, consists of a storage device(s) (11). The storage device is used to store sensed, calculated, transferred, queued, received, or any other data capable of being stored on a data storage device. For example, but not intending to be a limitation, the invention may store data related to objects it has sensed for later use. As another example, it may store data for transfer to a central storage server or device to be shared with other devices, or 3rd parties. Example, but not limiting, data that could be stored includes geographic position, elevation, object type, type confidence, calculated risk, date, time, or other parameters sensed or calculated concerning sensed items or conditions. In some embodiments, but not all, the invention is connected to a network(s) and/or external system(s) (12). The invention may transfer data from itself to the external system via the network (12) or may receive data for internal use from the network (12).

As indicated in FIG. 1, the invention, in some embodiments, but not all, consists of a pilot interface(s) (9), which may include, but not intended to be a limitation, a display(ies) (7) for a visual interface, speaker(s) or headset(s) (6) for producing audio output, or a tactile sensation generating device(s) (8). The pilot interface, regardless of the mode or method, provides the pilot with information regarding the information sensed, calculated, reported, or other, by the invention. It also serves as a means to warn the pilot of potentially hazardous conditions. In some embodiments, but not all, this can be done using one or multiple interfaces to provide the pilot with pertinent information efficiently but without harmful distraction.

Furthermore, as indicated in FIG. 1, the invention, in some embodiments but not all, consists of a connection to an onboard or an external aircraft system(s) (10). For illustrative purposes, but not intending to be a limitation, this may include one-way or two-way data connections to a flight instrument(s), external data source(s), engine monitoring equipment, avionics, autopilots, flight control computers, or internal or external aircraft and support systems.

Figure 3:
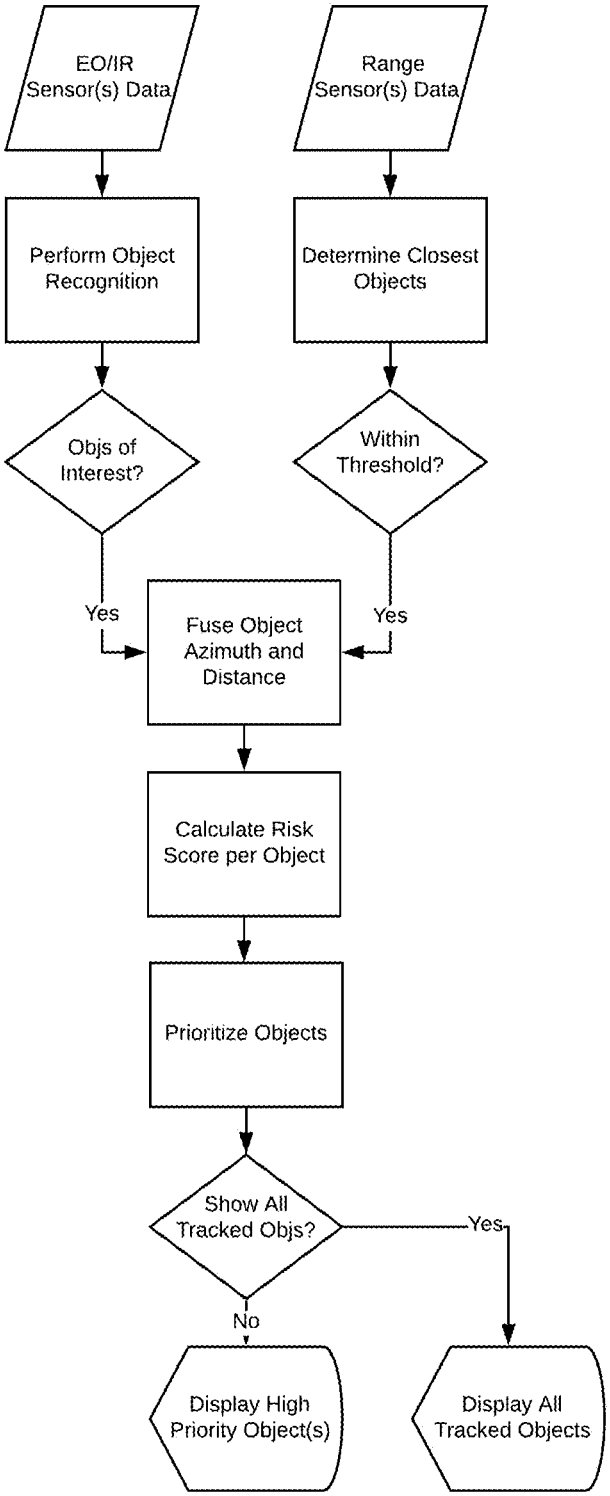
FIGS. 3, 4 and 5 are flow charts depicting implementations of one or more possible embodiments of the present invention.

FIG. 3 illustrates one possible embodiment of the invention that is, like the other embodiments, novel and useful. Referring to the diagram, electro-optical ("EO") and/or infrared ("IR") sensor data is processed by the invention using object recognition to determine if any objects of interest exist in the video frame. If so, the object is categorized and/or tracked. Concurrently, range sensor data is processed to determine the distance of objects in the vicinity of the aircraft. For illustrative purposes, but not intending to be a limitation, the range data may be gathered by a stereoscopic camera(s), radar(s), an ultrasonic sensor(s), lidar(s), laser rangefinder, or sensor capable of measuring distance to an object. If the objects are determined to be within a range threshold, the location and range data is passed forward for additional processing.

In some embodiments, but not all, the Object Recognition process is not limited to recognizing object types. The process can also recognize a variety of items and characteristics, including but not limited to, text, signs, markings, lettering, numerals, ground markings, colors, warnings, and other items used to convey information. As an example, but not intending to be a limitation, the optical camera or infrared sensor detects a solid yellow line parallel to a dashed yellow line painted on the ground in the vicinity of the aircraft. The computer recognizes this marking as a hold short line which is used in aviation to indicate that the aircraft should not proceed past this marker without permission and/or determining it is safe. Hold short lines are often placed at the entrances to runways. It can be extremely dangerous for an aircraft to pass such a line while another aircraft is taking off or landing. Incidents and accidents have frequently happened when pilots neglected to see the hold short line or were confused about their position on the airport. In this example, the computer will recognize using the Object Recognition process that a hold short line is in front of the aircraft and present a warning to pilot, whether visually, aurally, tactilely, and/or otherwise, that they should not proceed without permission or ensuring it is safe. In this example, the computer can also transmit information concerning the recognized hold short line to other avionics and systems, whether onboard or external, to allow them to make use of the data. An example being, but not intending to be a limitation, an autobraking system that will apply the brakes if the aircraft attempts to cross the line without acknowledging its presence. These are additional useful and novel capabilities of the invention further providing benefit and increasing overall safety.

Any recognized objects in the EO and/or IR data are fused with the range data to create a two or three-dimensional data item(s) for each object of interest. This is performed by combining the data from the EO/IR sensor and distance from the range sensor to create the multi-dimensional data.

The range data, object classification, and multi-dimensional data are passed to a risk assessment algorithm that utilizes multiple parameters to calculate a risk calculation (also referred to interchangeably as "risk score" or "risk" or "score") for each object of interest. For illustrative purposes, but not intending to be a limitation, the parameters used by the risk assessment algorithm to calculate the object risk score may include object distance, object position, object movement, aircraft movement, type of object, historical risk factors, and other pertinent information about the object, the flight environment, the aircraft, or internal and/or external risk factors.

Object risk scores are compared with each other and a risk threshold to suppress, promote, rank and/or prioritize objects. This illustrates yet another useful and novel capability of the invention. The attention that a pilot or operator has to give to any given task is a limited resource. By prioritizing the objects according to calculated risk, only hazards that exceed a certain level of calculated risk can be presented to the pilot or operator of the aircraft. Conversely, potential hazards that are below a certain level of calculated risk can be suppressed. This helps the pilot avoid "data overload" and/or "task saturation". The pilot is assisted in focusing on items that are of high importance while disregarding items that are of low importance. Furthermore, by prioritizing hazards, the pilot can quickly determine which hazard(s), if any, at any given moment is the most important and demands the most attention. This reduces the overall risk of the flight and can prevent accidents caused by not recognizing a potential risk and/or recognizing a risk but becoming so fixated on it that other, potentially hazardous aspects of flying the aircraft are ignored.

Once objects and/or hazards are prioritized, they can be presented to the pilot using one or more of the interfaces. FIG. 3 represents these steps using the terms "Display" and "Show" for illustrative purposes, however, any method, including but not limited to using visual, audio, and/or tactile interfaces, may be utilized. If so selected, all objects, or a subset thereof, can be presented to the pilot regardless of calculated risk or priority using one or more of the pilot interfaces.

Figure 4:
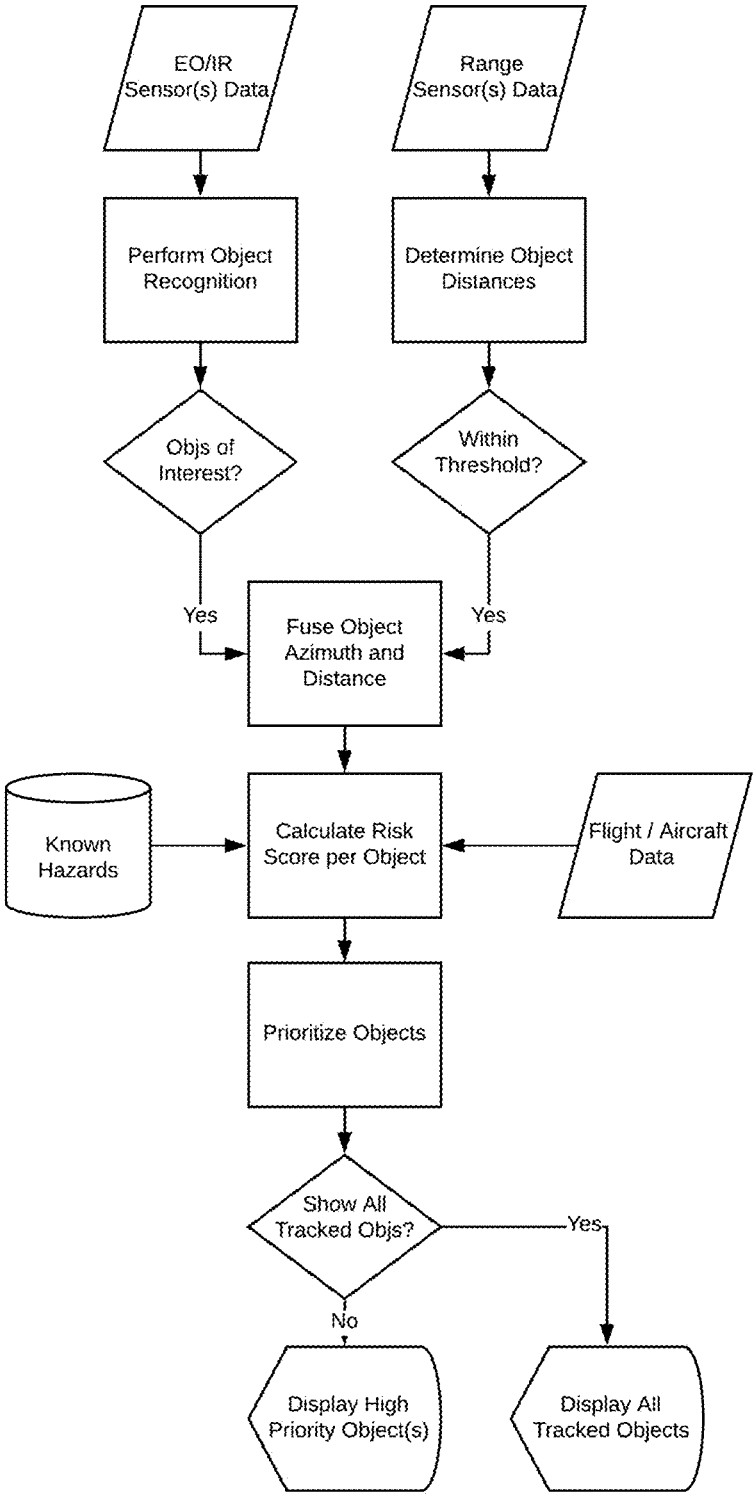

FIG. 4 illustrates a similar embodiment of the invention where additional information is included in the risk score calculation. Here, previously known hazards, conditions, objects, items, and/or pertinent information (collectively referred to in FIG. 4 as "Known Hazards") is stored in a data storage device and taken into account during risk score calculation. In addition, live flight and/or aircraft data is provided by sensor(s), an aircraft system(s) and/or an outside device(s) (collectively referred to in FIG. 4 as "Flight/Aircraft Data"). This information is included by the algorithm and computing device performing the risk score calculation. For brevity, both Known Hazards and Flight/Aircraft Data are included in FIG. 4, however embodiments of the invention may include neither, one or both of the depicted items.

The Known Hazards may include objects and/or hazards provided by outside sources or objects and/or hazards previously sensed, processed, or inferred and stored by the invention. In some embodiments, but not intending to be a limitation, the invention compares the calculated position of the detected hazards to the known position of the stored hazards, as well as other stored and detected properties of the hazards, to determine if they refer to the same object. If so, the invention ignores or takes into account the stored information regarding the hazard to aid in the risk calculation for that object. This is a novel and useful feature of invention in that the invention is herein utilizing both historic data as well as live sensed information about an object or hazard to calculate a more robust and informed risk score. This ultimately provides better information to the pilot reducing overall flight risk and the potential for an accident.

The Flight/Aircraft Data may be included in certain embodiments, but not all, with the total information processed and considered by the invention. For illustrative purposes, but not intending to be a limitation, this data may include airspeed, altitude, vertical speed, position, direction, attitude, movement, control positions, engine monitoring data, avionics data, autopilot information, weather, precipitation, wind speed, wind direction, temperature, and/or other information pertinent to the flight and/or aircraft. Including such information in the risk score calculation is useful and novel in that the risk can be better calculated using more robust, fused data than by using static data from databases or data obtained from individual sensors.

As an example of fusing data from multiple sources, but not intending to be a limitation, the invention can use data indicating the movement of the aircraft to place added risk on objects sensed and calculated to be in the direction of travel. This would emphasize objects that the aircraft is moving toward that present higher collision risk and, conversely, de-emphasize objects from which the aircraft is moving away. As another example, but not intending to be a limitation, the invention can use engine monitoring data to determine if the aircraft is operating at or near maximum power. If so, the aircraft may have difficulty climbing thereby making it unable to reliably gain altitude. Given this condition, the invention may calculate increased risk scores for objects further from or higher than the aircraft because the aircraft may experience added difficultly climbing to avoid a collision with the object(s). The increased risk scores can be used to prioritize the information and provide more informed warnings to the pilot of the hazardous condition. These warnings may have been missed or impossible to determine without the utilization of fused data from multiple sensors, systems, and/or data sources.

The previous two examples demonstrate another novel and useful feature of the invention. Fusing information from the current flight environment, flight parameters, aircraft system functioning, and/or collected data provides a comprehensive and automated risk assessment and warning to the pilot thereby permitting the pilot to make more informed and timely decisions.

Figure 5:
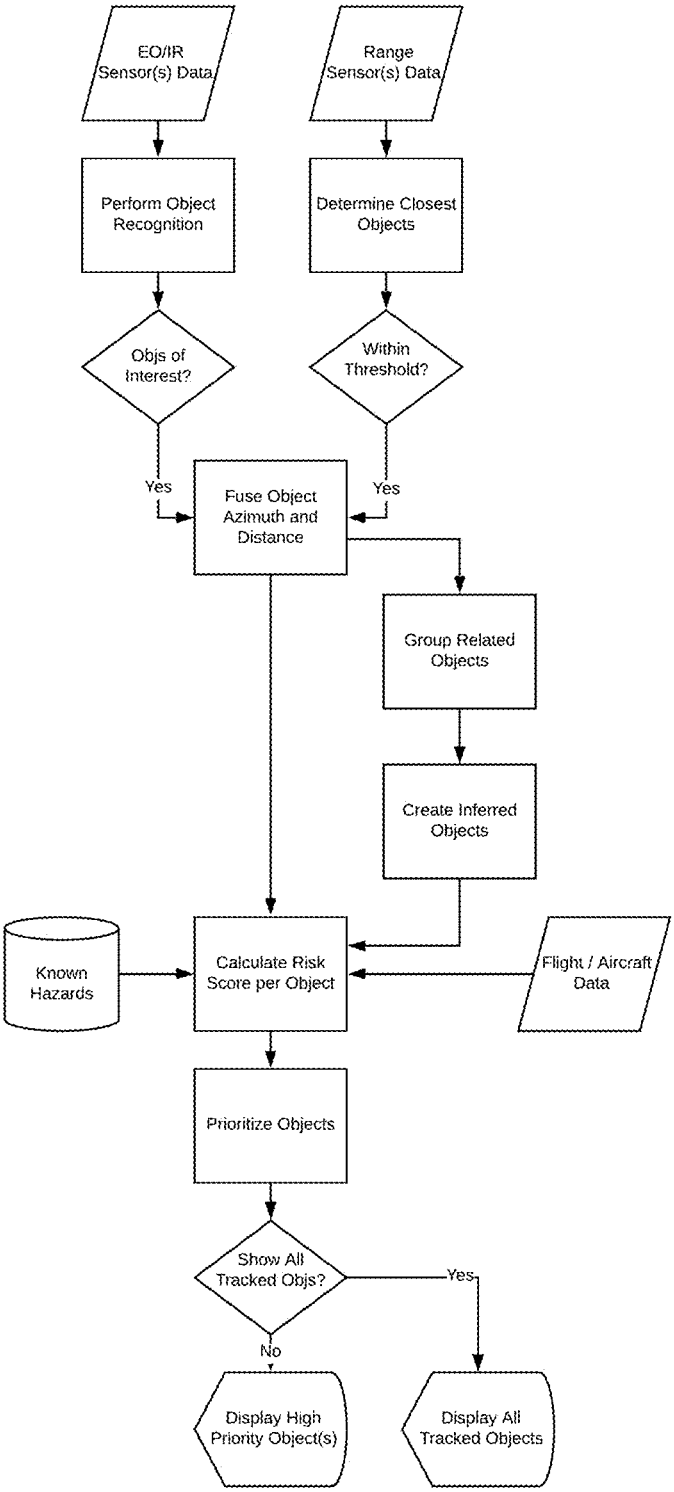

FIG. 5 illustrates a similar embodiment of the invention with the addition of inferred object and condition prediction (collectively referred to in FIG. 5 as "Inferred Objects"). For brevity, this embodiment is depicted in the illustration with other embodiments and components, however the invention may include all, none or any combination of components and processes as is practical and useful.

Inferred object and condition prediction refer to the calculation of possible hazards that have not been directly detected or sensed but that may exist given the current or previously sensed, detected, transferred, stored or processed objects and conditions in the aircraft's vicinity.

For example, but not intending to be a limitation, power transmission wires strung between towers or "telephone poles" can be difficult to detect. However, the towers and/or poles themselves can be detected in many instances. In this embodiment, the invention senses objects, use object recognition to categorize them as towers and/or telephone poles and subsequently determines their position. Using this information, the invention infers that power transmission wires are likely strung between the poles/towers and creates an "inferred" wire between the poles. This can be classified as a potential hazard, have a risk score calculated and assigned, and handled just like any other detected or processed object. For example, but not intending to be a limitation, it can be stored in a database, transmitted to other systems, and/or presented to the pilot using one or more interfaces. This is a novel and useful feature in that objects that are not directly detected or sensed can still be assessed and presented to the pilot giving them a better representation of the potential hazards in the vicinity of the aircraft.

Inferring hazards can be extended beyond calculating the potential for physical objects that have not been directly detected. In some embodiments, but not all, the invention determines if a flight condition may exist taking into account the objects sensed and/or inferred, and/or the flight environment detected, and/or external information received, and/or information stored. For illustrative purposes, but not intending to be a limitation, landing a helicopter next to a building may cause accelerated airflow from the main rotor to push up the side of the building and reenter the rotor system. This can lead to a condition known as vortex ring state which is especially hazardous to rotorcraft. In the example case, the invention can use the detected and categorized objects to determine if it is near a flat object such as a building, wall, or hanger. It can determine the distance from the flat object, take into account other objects in the area, and calculate the potential of the aircraft entering vortex ring state. If so, the invention can create a risk score for the hazard and warn the pilot of the potentially hazardous condition. This demonstrates a novel and useful feature of the invention wherein the invention's ability to detect and categorize objects, structures, hazards, and other information germane to the flight can be used to recognize a single or group of conditions that may create a hazardous flight environment. Ultimately the invention can, in some embodiments but not all, calculate a risk value for the hazardous condition and, if appropriate, warn the pilot.

Figure 6:
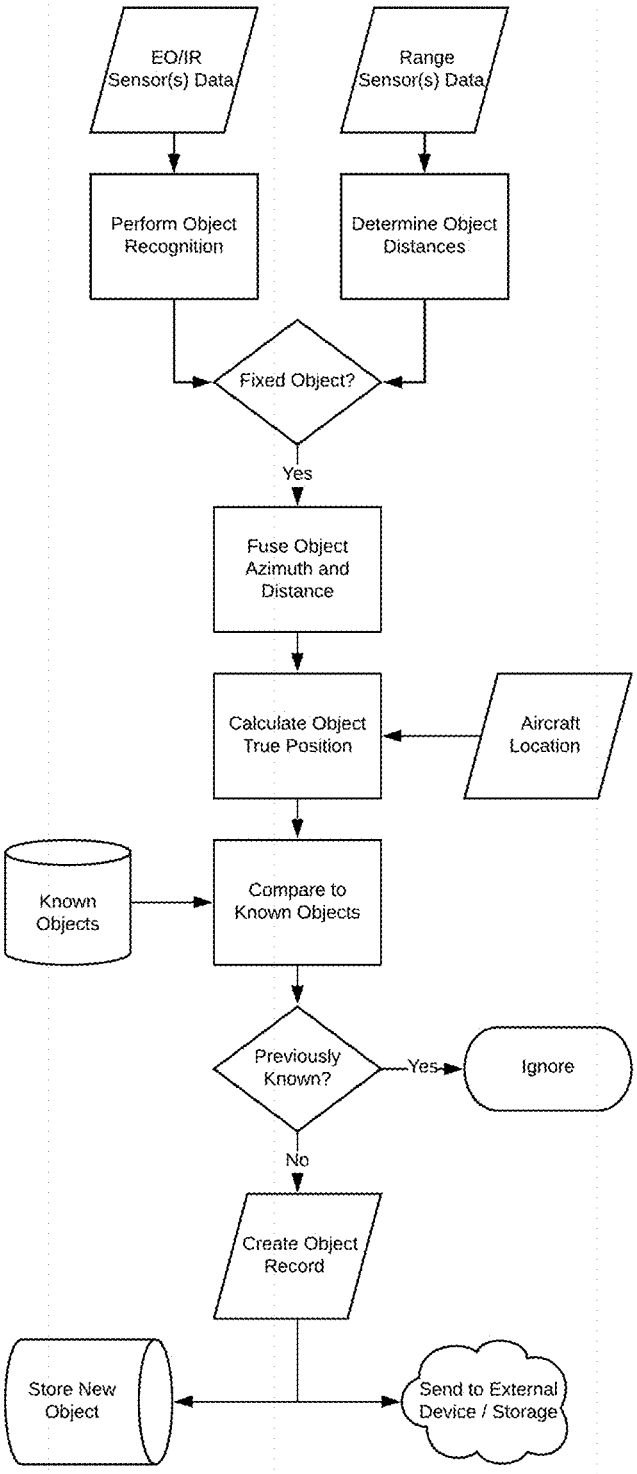
FIG. 6 is a flow chart depicting an implementation of one or more possible embodiments of a data sharing module of the present invention.

FIG. 6 illustrates another embodiment of the invention wherein the invention internally stores and/or sends to outside sources data regarding objects, hazards, conditions, terrain, or other information regarding the aircraft or flight environment, that it has sensed, detected, inferred, and/or processed. This embodiment not only improves the functionality and usefulness of the invention to its users, it also provides data to third parties for uses such as, but not intending to be a limitation, cartography, aviation hazard database creation, construction planning, environmental research, autonomous guidance database creation, intelligence gathering, or known, currently unknown, or future pursuits that could benefit from such information. This embodiment may operate in a stand-alone manner or may be included as additional functionality with other embodiments of the invention.

Referring to FIG. 6, the invention collects data from a sensor(s) and processes it as in previous embodiments. However, in this embodiment, the invention determines if an object is fixed in nature, such as a structure, or dynamic in nature, such as a vehicle. If it is a fixed object, the invention uses the data as well the aircraft's location to determine a "real world" location of the object. As an example, but not intending to be a limitation, the invention senses, processes, and determines the latitude and longitude of a processed object such as a power transmission tower. In some embodiments, but not all, the invention compares the detected and processed tower to a database of known objects. If the detected and processed tower is not contained in the data, i.e., not previously known, the invention creates an object record including all, or a subset of, the information collected, detected and processed regarding the object. The object record is then stored on a local or remote storage device and/or transmitted to a local or remote computer system and/or network.

This embodiment provides another useful and novel feature of the invention. As an example, but not intending to be a limitation, current object and hazard datasets typically only include large or significant objects such as high-rise buildings and the largest towers. They do not contain the vast majority of smaller structures, vegetation, low and medium height poles, as well as many other objects. However, these types of objects can present just as much danger to an aircraft as the larger items. Furthermore, traditional, centrally stored data sets are slow to be updated and may contain incorrect or out of date information. Therefore, it would be advantageous to build a data set of currently uncharted, unrecorded, or rarely recorded objects in an efficient and effective manner.

Crowdsourced data refers to a method of data gathering in which an occasionally public and relatively large group of individuals gathers data, perhaps autonomously or as a secondary background task performed by a device they use. The data is then aggregated from the individual devices into a larger data set. This method often provides less expensive and wider ranging data than could be gathered by an individual or a single organization.

In this embodiment, the collection of object and environment data by all, or a subset of, the inventions in use can be aggregated and stored as a crowdsourced data set of objects, potential hazards, and related information. For illustrative purposes, but not intending to be a limitation, this data can be shared with other users of the invention to provide better coverage of hazards, provide additional information about conditions in the area, used for flight planning purposes, used to better select landing zones, determine emergency landing areas, or other pre-flight or in flight uses. In addition, for illustrative purposes but not intending to be a limitation, the data can be shared, whether in raw or curated form, with third parties and non-users of the invention for a multitude of additional uses, including but not limited to, creating hyper-accurate maps of structures, vegetation, terrain, or other data collected and stored by the invention, for determining potential landing areas for autonomous, manned or unmanned vehicles, for performing research, for creating and updating databases, for create or updating autonomous navigation databases, or for a multitude of other potential uses whether currently known, unknown, or that may be developed in the future.

While the present invention has been described herein in terms of specific embodiments, it is to be understood that the invention is not limited to these disclosed embodiments. Many modifications and other embodiments of the invention will come to mind of those skilled in the art to which this invention pertains, and which are intended to be and are covered by this disclosure.

The invention claimed is:

1. In a hazard detection system adapted for use on an aircraft and configured to connect to onboard sensors, a method comprising:

processing pixelized data from a first set of onboard sensors to identify objects of interest;

processing range sensor data from a second set of onboard sensors to generate distance data with respect to identified objects;

feeding, the identified objects of interest, the distance data, and a hazard classification of the objects of interest, to a risk assessment algorithm to generate a risk calculation score for each identified object of interest;

identifying multiple hazards, including high priority hazards and lesser priority hazards, based on the risk calculation score of each identified object; and generating, as an output, risk profile information to permit evasive action to be taken on at least one of the high priority hazards, while providing no feedback or hazard information about lesser priority hazards;

wherein the hazard detection system further comprises a database of expected objects along a known flight path, and wherein identified objects of interest are unexpected objects along the known flight path.

2. The method of claim 1, wherein the hazard detection system includes a display, and wherein generating the risk profile information involves prominently displaying a visual representation of at least the highest priority hazard among the high priority hazards on the display.

3. The method of claim 1, wherein the hazard detection system is adapted to connect to at least one of an onboard display and flight control system in the aircraft configured to receive the risk profile information and alert the pilot to the high priority hazards.

4. The method of claim 1, wherein the hazard detection system is adapted to remotely communicate with a ground fight control system configured to receive the risk profile information and alert a ground flight control system operator of the high priority hazards.

5. The method of claim 1, wherein the hazard detection system is adapted to communicate with an onboard flight control system configured to receive the risk profile information and take evasive action automatically in response to the high priority hazards.

6. The method of claim 5, wherein the hazard detection system is designed to offload at least certain hazard detection and evasion events from the flight control system to the hazard detection system for more efficient and timely evasive action.

7. The method of claim 1, wherein identifying objects of interest involves identifying objects of interest otherwise not directly detectable from the onboard sensors coupled to the hazard detection system by inferring objects from identified objects that are detectable from onboard sensors coupled to the hazard detection system.

8. The method of claim 7, wherein the taking of an evasive action involves avoiding an inferred object.

9. The method of claim 8, wherein the aircraft is an unmanned aerial vehicle and the evasive action avoiding an inferred object is taken by an onboard flight control system or remotely.

10. A hazard detection system for use on an aircraft that limits evasive action to only high risk hazards, comprising:

means for processing pixelized data from a first set of onboard sensors to identify objects of interest;

means for processing range sensor data from a second set of onboard sensors to generate distance data with respect to identified objects;

means for feeding (i) the identified objects of interest, (11) the distance data, and (iii) a hazard classification of the objects of interest to a risk assessment algorithm to generate a risk calculation score for each identified object of interest;

means for identifying multiple hazards, including high priority hazards and lesser priority hazards, based on the risk calculation score of each identified object; and means for generating, as an output, risk profile information to permit evasive action to be taken on at least one of the high priority hazards, while providing no feedback or hazard information about lesser priority hazards wherein the hazard detection system further comprises a database of expected objects along a known flight path, and wherein identified objects of interest are unexpected objects along the known flight path.

11. The hazard detection system of claim 10, wherein the hazard detection system includes a display, and wherein means for generating the risk profile information involves prominently displaying a visual representation of at least the highest priority hazard among the high priority hazards on the display.

12. The hazard detection system of claim 10, wherein the hazard detection system is adapted to connect to at least one of an onboard display and flight control system in the aircraft, the latter being configured to receive the risk profile information and alert the pilot to the high priority hazards.

13. The hazard detection system of claim 10, wherein the hazard detection system is adapted to remotely communicate with a ground fight control system, the latter being configured to receive the risk profile information and alert a ground flight control system operator of the high priority hazards.

14. The hazard detection system of claim 10, wherein the hazard detection system is adapted to communicate with an onboard flight control system, the latter being configured to receive the risk profile information and take evasive action automatically in response to the high priority hazards.

15. The hazard detection system of claim 14, wherein the hazard detection system is designed to offload at least certain hazard detection and evasion events from the flight control system to the hazard detection system for more efficient and timely evasive action.

16. The hazard detection system of claim 10, wherein the means for identifying objects of interest includes means for identifying objects of interest otherwise not directly detectable from the onboard sensors coupled to the hazard detection system by inferring objects from identified objects that are detectable from onboard sensors coupled to the hazard detection system.

17. The hazard detection system of claim 16, wherein the taking of an evasive action involves avoiding an inferred object.

18. The hazard detection system of claim 17, wherein the aircraft is an unmanned aerial vehicle and the evasive action avoiding an inferred object is taken by an onboard flight control system or remotely.

* * * * *